US010345072B1

(12) United States Patent
Webster

(10) Patent No.: US 10,345,072 B1
(45) Date of Patent: Jul. 9, 2019

(54) FLEXIBLE STRING DAMPER

(71) Applicant: Hoyt Archery, Inc., Salt Lake City, UT (US)

(72) Inventor: John Christopher Webster, Stansbury Park, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 0 days.

(21) Appl. No.: 16/158,176

(22) Filed: Oct. 11, 2018

(51) Int. Cl.

| | |
|---|---|
| ***F41B 5/00*** | (2006.01) |
| ***F41B 5/14*** | (2006.01) |
| ***F41B 5/20*** | (2006.01) |
| *F41B 5/10* | (2006.01) |

(52) U.S. Cl.
CPC ..... *F41B 5/1426* (2013.01); *F41B 5/1407* (2013.01); *F41B 5/1411* (2013.01); *F41B 5/10* (2013.01)

(58) Field of Classification Search
CPC .... F41B 5/1411; F41B 5/1415; F41B 5/1419; F41B 5/1423
See application file for complete search history.

(56) References Cited

U.S. PATENT DOCUMENTS 3,703,771 A * 11/1972 Saunders ..... F41B 5/1419 33/265
4,011,853 A * 3/1977 Fletcher ..... F41B 5/1419 124/87
4,656,747 A * 4/1987 Troncoso ..... F41G 1/467 124/87
5,347,976 A * 9/1994 Saunders ..... F41G 1/467 124/87
5,676,123 A * 10/1997 McPherson ..... F41B 5/14 124/90
8,281,777 B2 * 10/2012 Bach ..... F41B 5/1426 124/87

* cited by examiner

*Primary Examiner* — John A Ricci
(74) *Attorney, Agent, or Firm* — Dorsey & Whitney LLP

(57) ABSTRACT

Flexible string dampers can include resilient bodies configured to be inserted between strands of a bowstring or cable in archery equipment. The dampers can include openings or recesses in along their longitudinal or transverse axes to provide additional flexibility and vibration dampening. Accessories and inserts can be added to the bowstring by positioning them within the openings or recesses, and the accessories and inserts can be exchanged from the bowstring without removing the damper and without needing external equipment such as a bow press to reduce tension on the string or cable. A damper can also be used as a peep sight with a central opening configured to change in width in response to changes in tension in the strands holding it in place.

23 Claims, 8 Drawing Sheets

FLEXIBLE STRING DAMPER

TECHNICAL FIELD

The present disclosure generally relates to archery equipment and specifically relates to dampers for bowstrings.

BACKGROUND

Bowhunters and other archers use eccentrics and finely tuned archery equipment to improve performance. Various modifications and accessories to their equipment can improve the accuracy, efficiency, convenience, safety, and, in some cases, sound of their bows. Reduction of vibrations is one modification of frequent interest. For example, when an arrow or other projectile is shot from the bow, the limbs, bowstring, and other connected elements of the bow can vibrate as energy dissipates from the limbs and is transferred to the projectile. The vibrations can cause archer fatigue, can induce errant movements of the bow or projectile, can be destructive and reduce the life of the equipment, and can cause unwanted noise, among other things. Accordingly, there is a constant need for improvements to various types of archery equipment that reduce or dampen vibrations.

SUMMARY

One aspect of the present disclosure relates to an archery bowstring damper which can comprise a body including a main body portion having an outer surface, a first end, and a second end. The body can have a first flared portion at the first end and a second flared portion at the second end, wherein the outer surface, the first flared portion, and the second flared portion form a channel on the body.

In some embodiments, the main body portion further comprises a central aperture. The main body portion can comprise a longitudinal axis, with the central aperture extending partially along the longitudinal axis. The body can also be a first body and the damper can further comprise a second body positioned in the central aperture. In some embodiments, the central aperture can be a first central aperture and the second body can comprise a second central aperture. The second body can comprise a third flared end and a fourth flared end. In some embodiments, the body can comprise a resilient material. The body can also comprise a circular or annular cross-sectional profile shape, and the first and second flared portions can comprise a circular or annular cross-sectional profile shape.

Another aspect of the disclosure relates to an archery bowstring which comprises a first strand and a second strand, with the first and second strands extending along a longitudinal axis. A compressible body can be positioned between the first and second strands and on the longitudinal axis, and the compressible body can have an opening. The opening can be configured to at least partially collapse as longitudinal tension on the first and second strands increases.

The first and second strands can be parts of a single continuous strand. The first strand can have a diameter and the compressible body can further comprise a flared end having a radial thickness greater than the diameter of the first strand. The bowstring can also further comprise a rigid accessory positioned in the opening of the compressible body, with the rigid accessory being attachable to the compressible body while the compressible body is positioned between the first and second strands. A compressible accessory can be positioned in the opening of the compressible body. The longitudinal axis can be a first longitudinal axis, and the opening can comprise a second longitudinal axis, with the second longitudinal axis being transverse to the first longitudinal axis. The compressible body can comprise a first channel portion and a second channel portion, with the first strand being positioned in the first channel portion and the second strand being positioned in the second channel portion.

Yet another aspect of the disclosure relates to an archery bow, comprising a riser, a first limb and a second limb, with the first and second limbs being attached to the riser, and a bowstring including a first strand bundle extending along a longitudinal axis from the first limb to the second limb and a second strand bundle extending along the longitudinal axis from the first limb to the second limb. A string damper can be positioned between the first and second strand bundles, with the string damper having an opening oriented substantially perpendicular to the longitudinal axis. The opening can have a first length when the bowstring is under a first tension and the opening has a second length when the bowstring is under a second tension.

In some embodiments, the first and second lengths are measured along the longitudinal axis, and the first length can be greater than the second length and the first tension can be greater than the second tension. The first and second lengths can be measured orthogonal to the longitudinal axis, the first length can be less than the second length, and the first tension can be greater than the second tension. The opening can be a through-hole. The opening can also be a recess in a side of the string damper.

Another aspect of the disclosure relates to a bowstring damper comprising a compressible body having a perimeter and a channel extending around the perimeter of the compressible body. The compressible body can be attachable to a bowstring and can be elongated in a longitudinal direction along the bowstring by compression of the compressible body by a portion of the bowstring in the channel, wherein elongation of the compressible body by the portion of the bowstring in the channel decreases upon a decrease in longitudinal tension in the bowstring.

In some embodiments, the compressible body can comprise an aperture having a central axis configured to intersect the vertical plane. The compressible body can also comprise an aperture, wherein the aperture has a width configured to change in response to a change in longitudinal tension in the bowstring.

Another aspect of the disclosure relates to an archery bowstring damper configured to be positioned between separated strands of an archery bowstring, the damper being laterally compressible and expandable when the bowstring transitions from a rest state to a fully drawn state. The damper can be aligned with a longitudinal axis of the archery bowstring.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
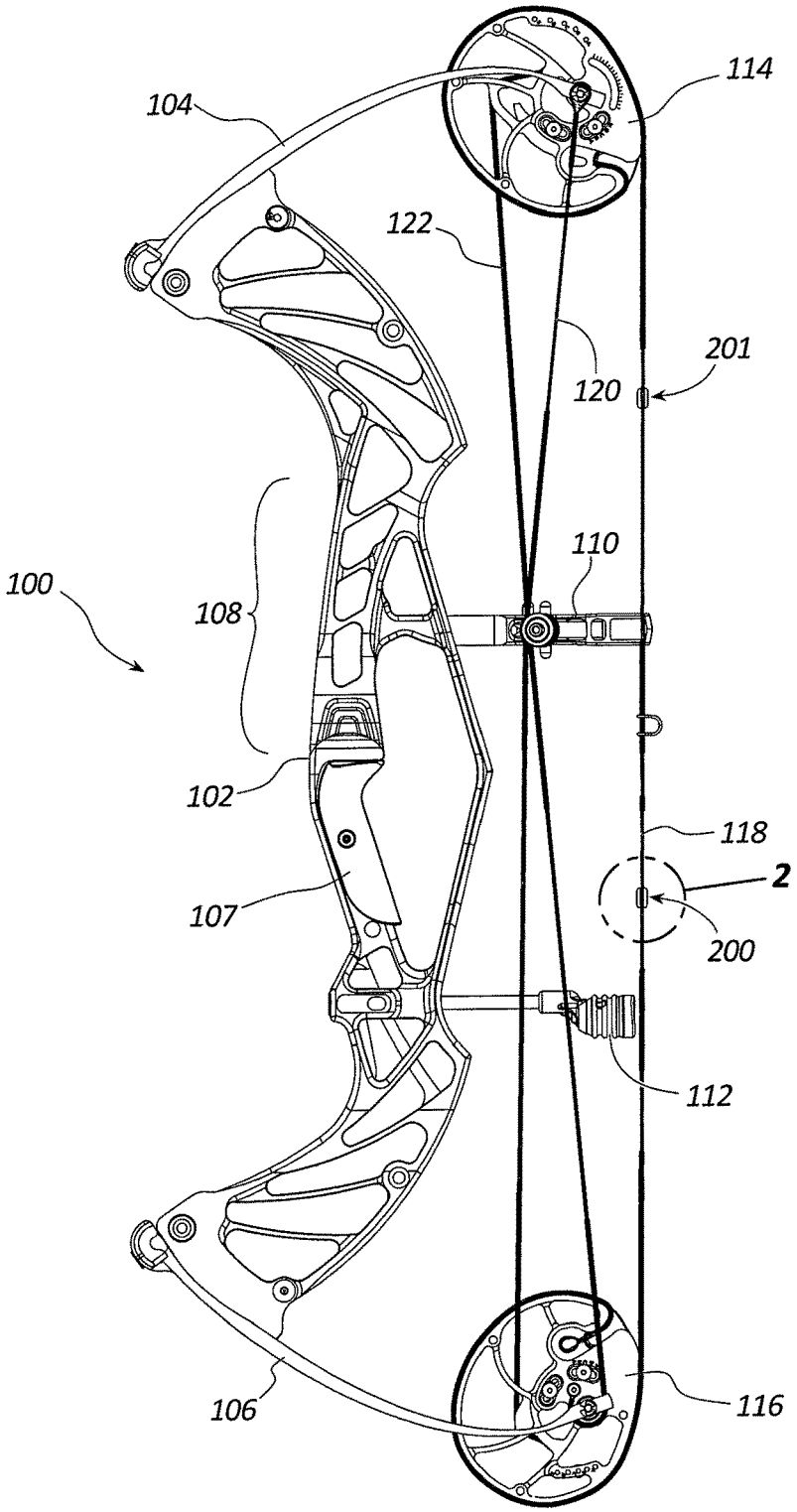
FIG. 1 is an isometric view of an archery bow.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to archery equipment and dampers for bowstrings. In one aspect of the disclosure, a resilient string damper is provided that is configured to reside between strands of a bowstring. The damper can have a main body portion with flared ends and at least one opening or recess extending into or through the main body portion. Radially-inwardly-directed forces applied to the lateral sides of the damper by the strands of the bowstring can compress the damper and reduce the size of the at least one opening or recess.

As tension on the strands changes, such as when the bowstring transitions from a brace condition to a drawn condition, the radially-oriented compressive forces applied to the damper also change, and the compliant material used in the string damper can change shape, such as by resiliently expanding. Rapid changes in the tension on the damper, such as the release of potential energy in the limbs and the resulting movement and vibrations of the bowstring, are dampened and absorbed by the damper as the released energy deforms the damper. An opening or recess in the damper can give the damper additional flexibility and absorptive properties that are not provided by conventional string dampers and related accessories. As used herein, a "compliant material" is a material that is deformable under typical loads associated with shooting an archery bow. In some embodiments, the compliant material is deformable in a bow subjected to longitudinal loads between about 5 pounds and about 300 pounds or in a crossbow subjected to longitudinal loads between about 50 pounds to about 600 pounds.

Another aspect of the disclosure relates to use of the string damper as an interface for removably installing accessories to the bowstring. In an example embodiment, the damper can be installed on a bowstring. A separate accessory such as a dampening rod, dowel, or tube can be inserted into or through the opening of the string damper in order to change the dampening properties of the damper. The rod or tube can comprise a different material from the damper, making the combined assembly more rigid than the damper alone. Thus, using the accessory can affect the hardness and weight of the damper assembly. Additionally or alternatively, other accessories, such as a d-loop, rest activation cord, peep sight, string weight, and related elements can be positioned in the damper opening. Accessories can be removed and exchanged for other accessories without having to remove the bowstring from the bow or place the bow in a press because the size of the damper opening (and the pressure on the accessory that keeps it in place in the opening) can be controlled by changing the tension on the string or deforming the shape of the damper.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Referring now to the figures in detail, FIG. 1 shows an archery bow 100 according to an embodiment of the present disclosure. The bow 100 is at a rest position (e.g., a brace position). The bow 100 can comprise a riser 102 from which upper limbs 104 and lower limbs 106 extend. The riser 102 may comprise a handle portion 107 (i.e., a grip), a sight window portion 108, a cable guard 110, a bumper string damper 112, and other parts and accessories commonly known in the art.

The upper limbs 104 may be connected to an upper cam 114, and the lower limbs 106 may be connected to a lower cam 116. A bowstring 118 (i.e., draw string) may extend across the length of the bow 100 between the upper cam 114 and the lower cam 116 when the bow 100 is positioned vertically upright in a normal shooting orientation. The terminal ends of the bowstring 118 may be attached to and held wrapped against the cams 114, 116, at least in the brace position, and the limbs 104, 106 may be flexed to store energy and retain tension in the bowstring 118. A yoked buss cable (YBC) 120 and a control buss cable (CBC) 122 may also be attached to and extend between the upper cam 114 and the lower cam 116. Collectively, the YBC 120 and CBC 122 may be referred to herein as the cables of the bow 100. The cables 120, 122 may retain tension in the limbs 104, 106 and cams 114, 116 and may be controlled to adjust tension in the bowstring 118, draw length of the bowstring 118, and other tuning features of the bow 100.

The bow 100 shown in the figures is shown for example purposes to illustrate an archery device that may be used in conjunction with the principles and teachings of the present disclosure. Thus, while the bow 100 is a compound bow, it will be understood by those having ordinary skill in the art that the features of the bowstrings, cables, and related methods and apparatuses included in embodiments of the present disclosure may be applied to strings and related methods and apparatuses in traditional bows, recurve bows, crossbows, and other related archery equipment. Similarly, archery equipment applying the teachings of the present disclosure does not need to implement all of the features of the present disclosure. For example, in some embodiments, the bow may not comprise a cable guard 110 or a string damper 112, so features associated with those accessories may be omitted from the strings of the bow.

When shooting an arrow, the tail end of the arrow may be nocked with the bowstring 118 at a nocking point while the bow 100 is in the rest position shown in FIG. 1. The bowstring 118 may be drawn rearward to a full draw position, thereby partially unraveling the bowstring 118 from the outer grooves of the cams 114, 116. The archer may grip the handle portion 107 of the riser 102 and draw back the bowstring 118 using a loop. As the limbs 104, 106 flex inward and the cables 120, 122 wind around the cams 114, 116, the cables 120, 122 may slide along or may be in rolling contact with portions of the cable guard 110, which may comprise at least one roller or other smooth support in contact with the cables 120, 122 where they contact the cable guard 110.

When the bowstring 118 is released, the potential energy in the limbs 104, 106 is released, and the bowstring 118 quickly accelerates back toward the rest position as it applies a shooting force to the arrow. As the limbs 104, 106 release their energy, they spread apart, and the terminal ends of the bowstring 118 wrap around the cams 114, 116, and the cables 120, 122 unwind from the cams 114, 116. A portion of the bowstring 118 may come into contact with the string damper 112, which may help dampen vibrations in the bowstring 118, and the cables 120, 122 may roll or slide against the cable guard 110 as the cams 114, 116 move. Vibrations and reverberations in the bow 100 may dampen out, at least partially due to dampening provided by a flexible string damper 200, and bow 100 may return to the brace position shown in FIG. 1. In this process, the cams 114, 116 and at least one roller may rotate relative to the limbs 104, 106 or cable guard 110 of the bow.

Vibration of the bowstring 118, cables 120, 122, and other parts of the bow 100 can negatively affect an archer's aim and accuracy, the structure and tuning of the bow, and the lifespan of the strings and other parts of the bow 100. Vibration also contributes to the loudness of noise made by the shooting the bow 100. Accordingly, aspects of the present disclosure relate to string dampers and related methods that may be used to address challenges faced by archers and bow makers.

Figure 2:
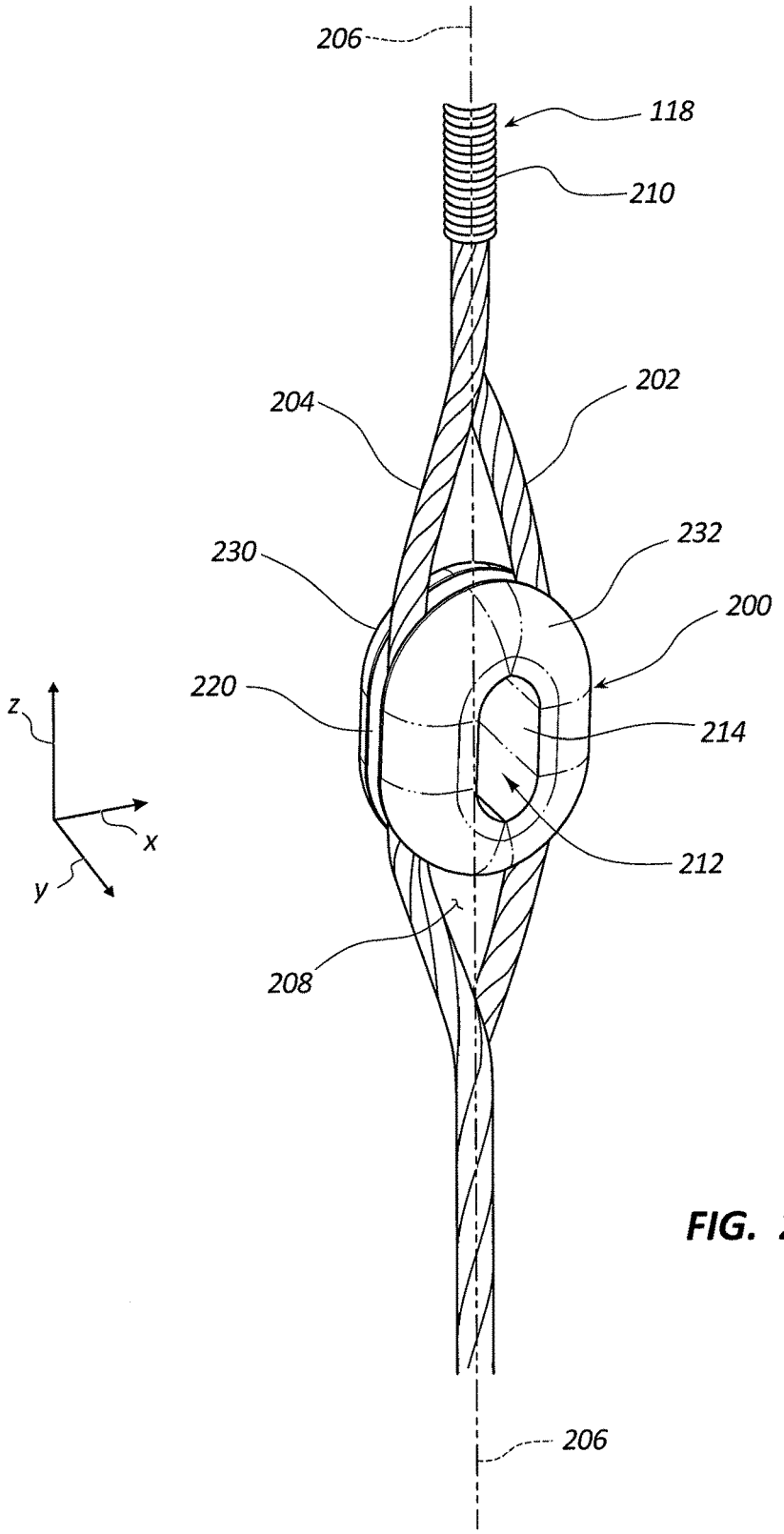
FIG. 2 is a detail view of a portion of a bowstring having a damper.

FIG. 2 is an isometric view of a portion of the bowstring 118 of FIG. 1 where the bowstring 118 and string damper 200 are located. In some embodiments, the damper 200 can be located at position 201, or on the YBC 120 or CBC 122 of the bow 100. The bowstring 118 can comprise at least two strands 202, 204, and the string damper 200 can be located between two sections of the strands 202, 204 that are laterally spaced apart from each other relative to a longitudinal axis 206 of the string 118 (which is parallel to the Z-axis in FIG. 2). Thus, there may be a transverse gap 208 with a width along the transverse or X-axis between the strands 202, 204 in which the string damper 200 is positioned. The strands 202, 204 can be located on opposite sides of the longitudinal axis 206 and positioned at substantially equal distances from the longitudinal axis 206. Thus, the damper 200 can be located centered on the longitudinal axis 206.

The strands 202, 204 can be entwined with each other. For example, the strands 202, 204 can be twisted together along their lengths to form a double-helical bowstring. The strands 202, 204 can be part of a single, long, continuous strand that is doubled over, creating a portion of parallel running strands 202, 204, so that a portion of the single long strand comprises the first strand 202 and another portion of the single long strand comprises the second strand 204. Alternatively, the strands 202, 204 can each be part of two or more entirely separate strands that are entwined. For example, the separate strands can be entwined by a different mechanical method or by application of a binding or serving material.

The strands 202, 204 can also comprise a set of sub-strands or filaments that are entwined to create each of the strands 202, 204. Thus, the strands 202, 204 can be referred to as bundles of strands or bundles of entwined filaments. The sub-strands or filaments of each bundle of strands does not cross between the first and second strands 202, 204 in the double helical twist of the strands 202, 204, such as in the portion of the bowstring 118 shown in FIG. 2. Thus, the sub-strands or filaments are separately entwined in each individual strand 202, 204. The strands 202, 204 can comprise a bowstring material such as, for example, composite carbon fiber, aramid, fiberglass, KEVLAR®, VECTRAN®, DYNEEMA®, other high modulus-polyethylene material, other thermoplastic material, metal or metallic fibers, related materials, and combinations thereof.

When tension in the bowstring 118 changes, the strands 202, 204 can increase or decrease their twist rate (i.e., the number of twists of the double helical bundle per inch). Lower tension can loosen the strands 202, 204 and therefore increase the twist rate and decrease stretching or elongation of the strands 202, 204, and higher tension can tighten the strands 202, 204 and therefore decrease the twist rate and increase elongation of the strands 202, 204. The elongation or contraction of the strands 202, 204 can apply varying pressure against the string damper 200 and can thereby affect its shape. The twisting or un-twisting of the strands 202, 204 can rotate the central longitudinal axis 216 of the damper 200. See FIG. 4.

A serving material 210 can be wrapped around portions of one or more of the strands 202, 204. The serving material 210 can comprise a different material than the strands 202, 204, and the location and tightness of the serving material 210 can affect how much the strands 202, 204 are permitted to untwist when there are changes in the tension in the bowstring 118.

Figure 3:
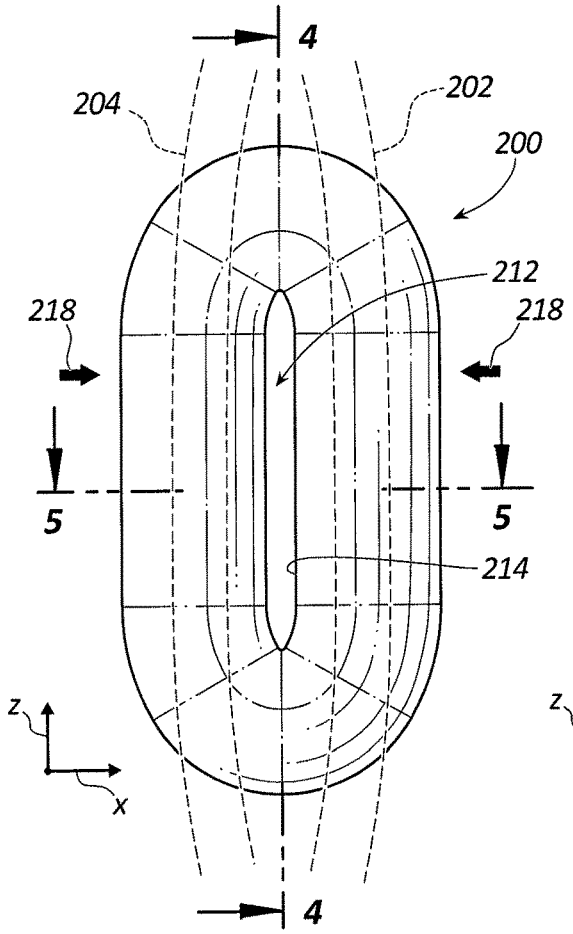
FIG. 3 is an end view of the damper of FIG. 2 in a high-compression condition.
Figure 4:
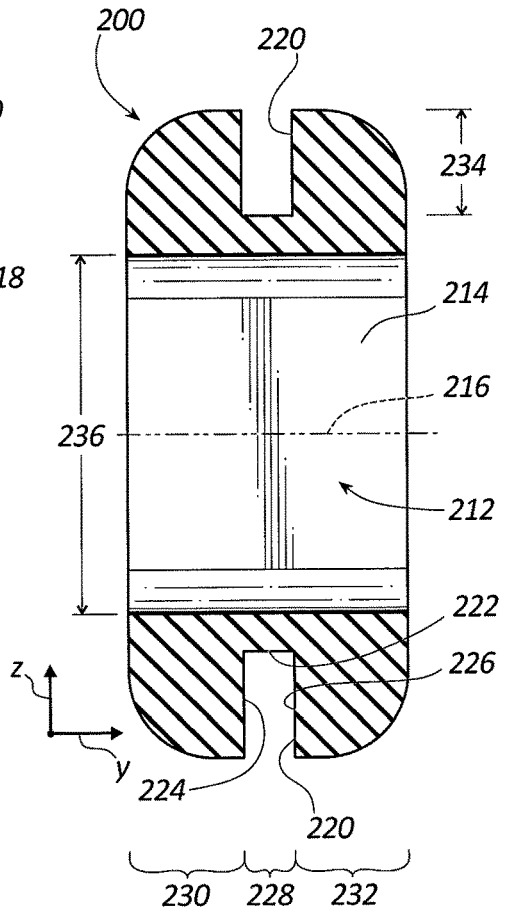
FIG. 4 is a section view of the damper of FIG. 2 as taken through section lines 4-4 in FIG. 3.
Figure 5:
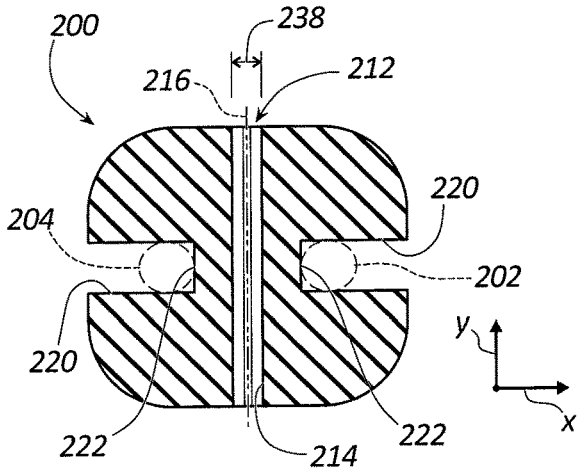
FIG. 5 is a section view of the damper of FIG. 2 as taken through section lines 5-5 in FIG. 3.
Figure 9A:
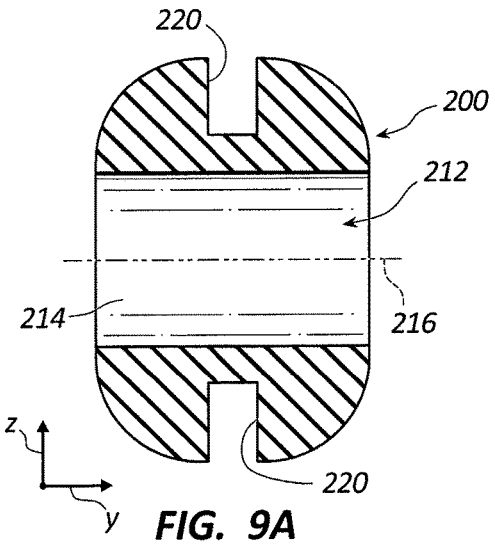
FIG. 9A is a side section view of the damper of FIG. 9 as indicated by section lines 9A-9A in FIG. 9.
Figure 9:
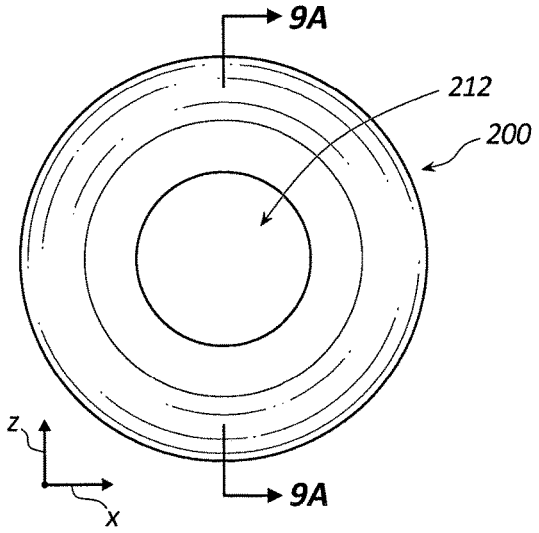
FIG. 9 is an end view of the damper of FIG. 2 in an unloaded condition.

Referring now to FIGS. 2-5, the string damper 200 is shown in the compressed shape it would have in a bowstring subject to a tension along its longitudinal axis 206. FIG. 3 shows an end view of the damper 200, and FIGS. 4 and 5 show cross-sectional views of the damper 200 respectively taken along section lines 4-4 and 5-5 in FIG. 3. FIG. 9 shows the damper 200 in an uncompressed state.

As shown in these figures, the damper 200 can include a central aperture, passageway, or opening 212. The central aperture 212 may be surrounded by a continuous elastomeric structure. For example, the central aperture may have a sidewall 214 that defines the entirety of the central aperture 212. The central aperture may comprise a passageway that is open on both ends and is aligned with a central longitudinal axis 216 (FIG. 4). The central longitudinal axis 216 can be referred to as an axis of symmetry since the damper 200 can be radially symmetric around it when the damper 200 is in an uncompressed or non-deformed state. See FIGS. 9 and 9A. The opening 212 can be referred to as a through-hole since it forms an open passage all the way through the damper 200. The arrows 218 in FIG. 3 indicate the general direction of the lateral forces applied to the damper 200 by the twist of the strands 202, 204 when the strands 202, 204 are under longitudinal tension (i.e., along bowstring longitudinal axis 206). The opening 212 can change its shape as lateral forces on the damper 200 change, as shown in FIGS. 5-9 and described in further detail elsewhere herein.

The damper 200 can comprise an outer groove or channel 220 running around its perimeter or circumference. The strands 202, 204 can be seated in the channel 220, as shown in FIGS. 2, 3, and 5. The channel 220 can have an inner wall 222 and two opposing side walls 224, 226. See FIG. 4. The inner wall 222 can be an outer surface of a central main body portion 228 of the damper 220, as shown in FIG. 4, and the side walls 224, 226 can each be part of first and second flared portions 230, 232, as indicated in FIGS. 2 and 4. The flared portions 230, 232 can be referred to as flared portions or enlarged width portions because they are flared or enlarged in width or diameter relative to the width or diameter of the main body portion 228.

The flared portions 230, 232 can block the strands 202, 204 from sliding off of the main body portion 228 along a direction parallel to the central longitudinal axis 216 of the damper 200 (i.e., along a direction parallel to the Y-axis). Thus, the damper 200 can resist being pushed out from between the strands 202, 204 in a direction parallel to the central axis 216 because of the flared portions 230, 232 coming into interference with the strands 202, 204. In some embodiments, the depth 234 (see FIG. 4) of the channel 220 can be greater than or equal to at least half of the diameter of the strands 202, 204. In one embodiment, the depth 234 is greater than the diameter of the strands 202, 204. The depth 234 can be referred to as a radial thickness of the walls of the flared portions 230, 232 since the depth 234 is measured radial to the central axis 216. In some embodiments, the depth 234 of the channel 220 can be limited so that the flared portions 230, 232 can deflect or compress and allow the damper 200 to be removed from the strands 202, 204 when tension on the strands is reduced. Thus, the damper 200 can be configured to be removable from the strands 202, 204. In some embodiments, the channel 220 can be replaced with two separate side channels, wherein each side channel retains one of the strands 202, 204 on each side of the damper 200. Thus, multiple channels can perform the function of the channel 220.

As shown in FIGS. 4 and 5, the widths 236, 238 of the opening 212 is different in a longitudinal direction (FIG. 4) as compared to a transverse direction (FIG. 5). Thus, longitudinal width 236 is greater than transverse width 238. In some embodiments, the transverse width is zero, meaning the sidewall 214 of the opening 212 collapses completely into contact along at least a portion of the longitudinal width 236. Vibrations absorbed by the damper 200 can be dampened by the material of the damper 200 and can also be dampened by contact between surfaces of the opening 212 that transfers vibration from one part of the damper 200 to another.

The damper 200 can comprise a resilient material. In some embodiments, the damper 200 can include urethane, rubber, silicone, polyvinyl chloride (PVC), thermoplastic polyurethane (TPU), other elastomeric materials, and combinations thereof. The resilience of the material can improve its dampening and energy dissipating characteristics and can make it easier to install or remove the damper 200 from a bowstring (e.g., 118). For example, the damper 200 can be compressed or otherwise deformed by a user in order to make it easier to insert the damper 200 between spread apart strands 202, 204 of the bowstring.

Figure 6:
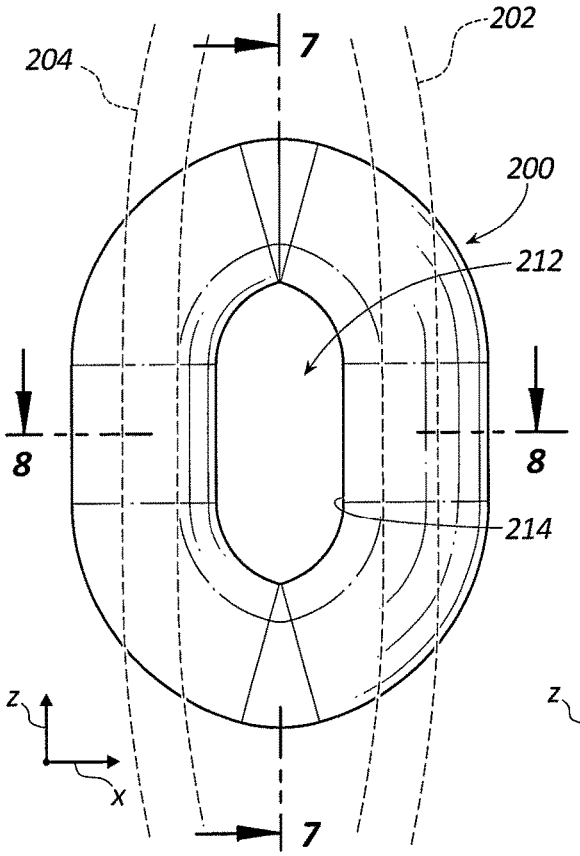
FIG. 6 is an end view of the damper of FIG. 2 in a lower-compression condition.
Figure 7:
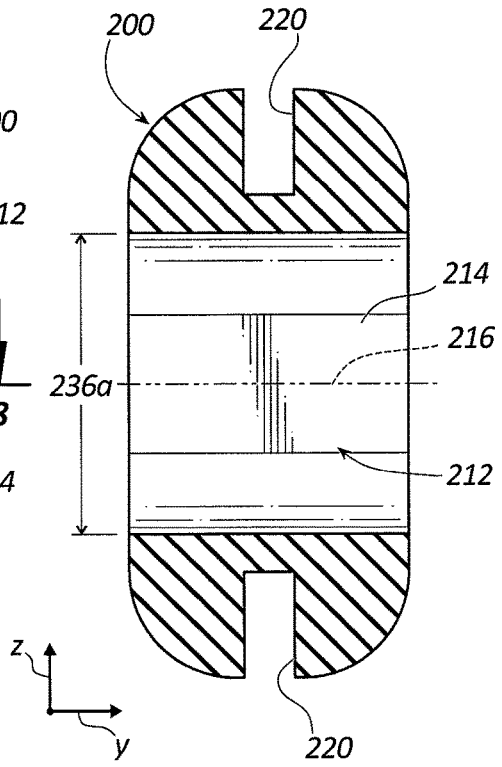
FIG. 7 is a section view of the damper of FIG. 6 as taken through section lines 7-7.
Figure 8:
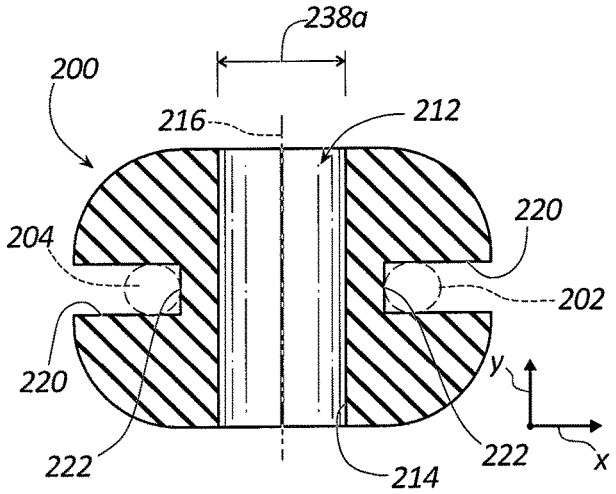
FIG. 8 is a section view of the damper of FIG. 6 as taken through section lines 8-8.

FIGS. 6-8 show another configuration of the damper 200, wherein the strands 202, 204 apply less pressure against the main body portion 228 and inner wall 222 as compared to the configuration shown in FIGS. 3-5. The configuration shown in FIGS. 3-5 can correspond to a brace condition of the bowstring 118 on the bow 100 since longitudinal tension is higher on the string in that condition, and the configuration shown in FIGS. 6-8 can correspond to a full draw condition of the bowstring 118 since longitudinal tension is lower on the string in that condition in a compound bow. In some embodiments, the tension in the string increases as the bow is drawn (e.g., in a traditional bow or in a YBC/CBC or similar cable in a compound bow), so the configuration of FIGS. 3-5 would represent a drawn condition, and the configuration of FIGS. 6-8 would represent a brace condition.

As seen in FIGS. 6-8, the damper 200 is less transversely compressed than in the previous configuration, and the opening 212 has a larger transverse width 238*a* and a smaller longitudinal width 236*a*. Accordingly, the opening 212 can be referred to as being broadened in the transverse direction and contracted in the longitudinal direction relative to the configuration shown in FIGS. 3-5. The reduced pressure against the damper 200 is not sufficiently low, however, to permit the damper 200 to fall out from its position between the strands 202, 204 inadvertently. Instead, the strands 202, 204 may still apply pressure to the damper 200 and thereby hold it in place along the longitudinal axis 206. Additionally, the strands 202, 204 may remain entwined tightly enough to keep the strands 202, 204 within the channel 220.

In some embodiments, the damper 200 can be used as a peep sight. For example, the damper 200 can be attached to the bowstring 118 at the peep sight position 201 shown in FIG. 1. The damper 200 can therefore be positioned on the bowstring 118 at a position for a peep sight, such as at a vertical position on the bowstring 118 that corresponds and horizontally aligns with the sights of the bow 100 when the bow is in an upright shooting position and the string is fully drawn. The opening 212 can be large enough to act as a sight aperture through which the sights of the bow 100 are visible. In some embodiments, the damper 200 has a reduced-transverse width opening 212 when the bowstring is in a brace condition, and the opening 212 increases in width when the bowstring is drawn. The action of drawing the bowstring 118 can increase visibility through the opening 212. The damper 200 can also be installed on the bowstring so that as the longitudinal tension on the strands 202, 204 changes and the damper rotates as a result, the central axis 216 is configured to turn from a first position out of alignment with at least one of the sights of the bow to a second position aligned with the at least one sight of the bow. For example, the damper 200 can face the archer at an angle similar to the orientation shown in FIG. 6. The archer can therefore aim the bow by viewing the sights (e.g., sight pins on the riser) through the opening 212.

FIG. 9 shows an end view of the damper 200 when it is completely unloaded and removed from the strands 202, 204. FIG. 9A shows a side section view of the damper 200 taken through section lines 9A-9A. The damper 200 can have a circular or annular unloaded shape, as shown in FIG. 9. The opening 212 and channel 220 can also have a circular shape. Thus, the radius or diameter of the opening 212 can be consistent in all directions around axis 216. The width of the opening is also different than the widths shown in the more compressed configurations shown in FIGS. 2-8. The opening 212, channel 220, and outer perimeter of the damper 200 can have the same shape, and the shape can have the same width along any width dimension perpendicular or radial to the central axis. In some embodiments, one or more of these features can have a different shape. The damper 200 can change its profile shape when it is loaded into the strands 202, 204 from the circular shape to an oblong or oval shape, as shown by comparing FIGS. 2, 3, 6, and 9. In some embodiments, the damper 200 can have another unloaded profile shape, such as, for example, an oval, rectangle, hexagon, cross- or t-shape, related shape, or combinations thereof. In an example embodiment, the damper 200 can have an elongated shape that, when loaded between the strands 202, 204, changes to a regular shape (e.g., a circle or square shape) when compressed.

Figure 10:
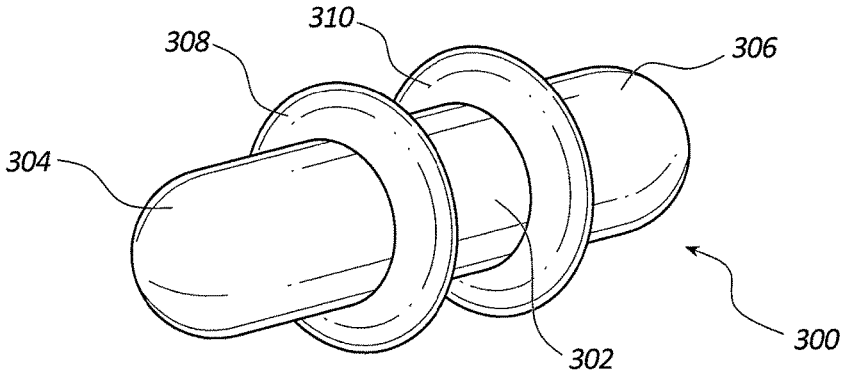
FIG. 10 is an isometric view of an insert for a damper.
Figure 11:
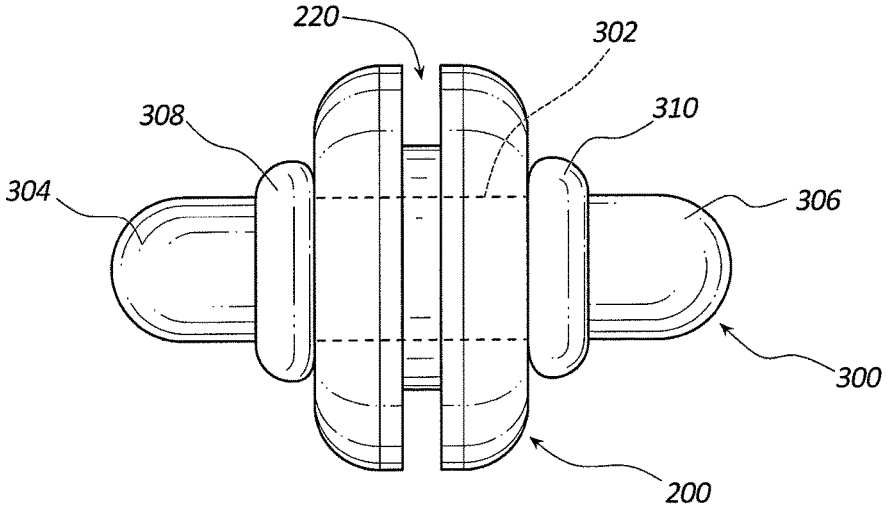
FIG. 11 shows a side view of the damper of FIG. 2 and the insert of FIG. 10.

Another aspect of the disclosure relates to the use of a damper with accessories for the bow. FIGS. 10-11 illustrate an example accessory. FIG. 10 is an isometric view of a rod insert 300 configured to be positioned through an opening (e.g., 212) of a damper (e.g., 200). FIG. 11 is a side view of the insert 300 shown positioned in the opening 212. The insert 300 can include a shaft 302 and two end dampers 304, 306. A pair of flared ends or stop rings 308, 310 can be positioned where the shaft 302 and end dampers 304, 306 meet each other. As shown in FIG. 11, the stop rings 308, 310 can be spaced apart so that they are external to the opening 212 when the insert 300 is positioned in the opening 212. The stop rings 308, 310 can therefore help prevent the insert 300 from being too easily or inadvertently pushed or pulled out of the opening 212.

The insert 300 can comprise a flexible and resilient material. The insert 300 can include one or more of the materials used in the damper 200 or, in some cases, can comprise different materials. For example, the insert 300 can comprise a flexible and resilient material that is more flexible and resilient than the damper 200. The insert 300 can also or alternatively comprise a relatively rigid material, wherein the insert 300 comprises a material that is more rigid than the damper 200.

The insert 300 can also be configured with a thickness or shape configuration that increases or decreases the rigidity of the insert 300 relative to the damper 200, such as by having apertures or openings through it that allow it to collapse or otherwise deform under load. See also FIGS. 12-13. The stop rings 308, 310 can comprise the same material as the shaft 302 and end dampers 304, 306. In other embodiments, the stop rings 308, 310 and/or shaft 302 can comprise a different material than the other parts of the insert 300. The stop rings 308, 310 can be separate parts that are positioned around the shaft 302.

The insert 300 can be held within the opening 212 of the damper 200 by the stop rings 308, 310 having a larger diameter than the diameter of the opening 212. In some embodiments, the stop rings 308, 310 have an equal or smaller diameter than the diameter of the opening 212 when the damper 200 is in an uncompressed condition (e.g., as shown in FIG. 9) or when the damper 200 is in a reduced-tension condition (e.g., the drawn condition shown in FIG. 6). Thus, the insert 300 can be pushed or pulled out of the opening 212 in those conditions. In another embodiment, the stop rings 308, 310 have a slightly larger diameter than the opening 212 in those conditions, and compression or deflection of the stop rings 308, 310 can allow the insert 300 to be pushed or pulled out of the opening 212 without permanently damaging (e.g., tearing or cracking) the insert 300. The stop rings 308, 310 can also comprise rounded or sloped sides or edges to facilitate sliding the insert 300 into and out of the opening 212. Accordingly, the insert 300 can be referred to as being selectively removable or selectively attachable to the damper 200.

Accordingly, another aspect of the disclosure relates to a damper in which accessories such as insert 300 can be exchanged or changed from one shape or type to another. A first insert (e.g., 300) having a first material composition or shape configuration can be inserted into the damper 200 in a first configuration of the damper, and a second, different insert having a second, different material composition or shape configuration can be inserted into the damper 200 in a second configuration. Thus, the properties of the damper and insert(s), as an assembly, can be modified or changed without having to remove the damper 200 from the bowstring.

In one example embodiment, a first insert can be used that is more rigid than the second insert. Each insert may provide different properties to the damper assembly as a whole. An archer desiring a relatively flexible damper assembly can place a higher-flexibility insert into the string, and an archer desiring a less flexible damper assembly can use a more rigid insert. If an archer desires to use the damper 200 as a peep sight, the insert 300 can be removed from the damper, and otherwise the insert 300 can be left in the damper 200. Keeping the insert 300 in the damper 200 can help prevent the damper 200 from potentially plastically deforming or being damaged. Additionally, the damper 200 can act similar to a grommet to protect the strands 202, 204 from damage or wear as accessories are exchanged on and off of the string 118 within the protective surfaces of the damper 200 that space the strands 202, 204 out of contact with the inserted accessories.

Figure 12:
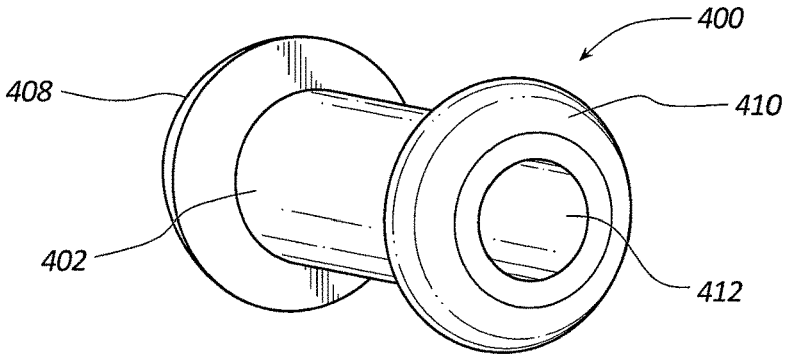
FIG. 12 is an isometric view of an insert for a damper.
Figure 13:
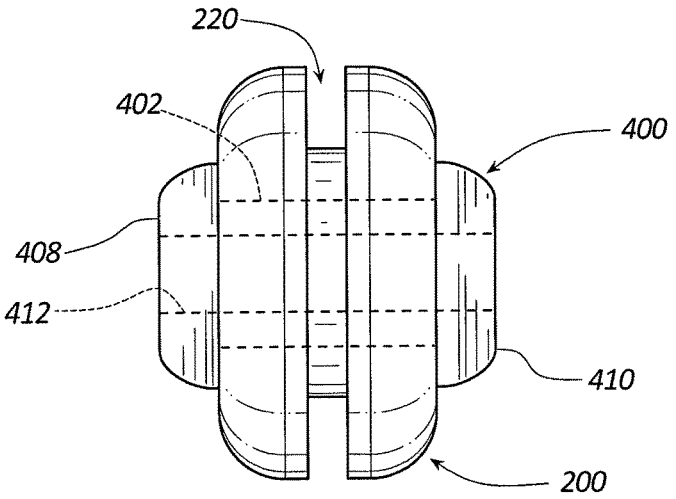
FIG. 13 shows a side view of a damper and the insert of FIG. 12.

In another embodiment, shown in FIGS. 12-13, a dowel-shaped insert 400 may be used. The dowel-shaped insert 400 can have a generally cylindrical shaft 402 with a central, axial bore 412 and flared ends or stop rings 408, 410. The dowel-shaped insert 400 can also be installed within the opening 212 of the damper 200 and can reinforce the damper 200 within the opening 212, as shown in FIG. 13. As with insert 300, the dowel-shaped insert 400 can comprise various materials that may or may not be the same as the damper 200. The bore 412 can reduce the radial or lateral rigidity of the insert 400 as compared to the solid shaft 302 of insert 300. Therefore, the insert 400 can be collapsible in a radial direction as the damper 200 applies radially-inward-directed forces to it at the surface of the opening 212.

In an example embodiment, the bore 412 can be used as a peep sight opening. The insert 400 can comprise a material with a rigidity configured to keep the bore 412 open and unobstructed at least when the bowstring is at full draw. The size, shape, and color of the damper assembly can be customized by the user without having to use a bow press or other equipment to release longitudinal tension on the bowstring 118 and thereby enable the accessories in the bowstring 118 to be modified or exchanged while in the field or without needing additional equipment to adjust tension in the string.

In some embodiments, the opening 212 or bore 412 can be used to support various other inserts or accessories. For example, string leeches, monkey tails, double-downs, string shocks, string weights, cat whiskers, and related accessories can be inserted through the opening 212 or held by the opening. The flexibility of the damper 200 can allow the opening 212 to change shape around the accessories and thereby apply a clamping force to hold the accessories in place via the pressure applied by the strands 202, 204. The clamping force applied to the accessory in the opening 212 can change as a result of changing longitudinal tension in the strands 202, 204. For example, the clamping force can have a first magnitude when the string is in a brace condition, and the clamping force can have a second, lower magnitude when the string is in a drawn condition or removed from the bow. The reduction in clamping force can allow the accessory to move more easily through the opening 212 and thereby be exchanged for another accessory or removed by drawing the bow or removing the string from the bow without also removing the damper 200 from the string.

Figure 14:
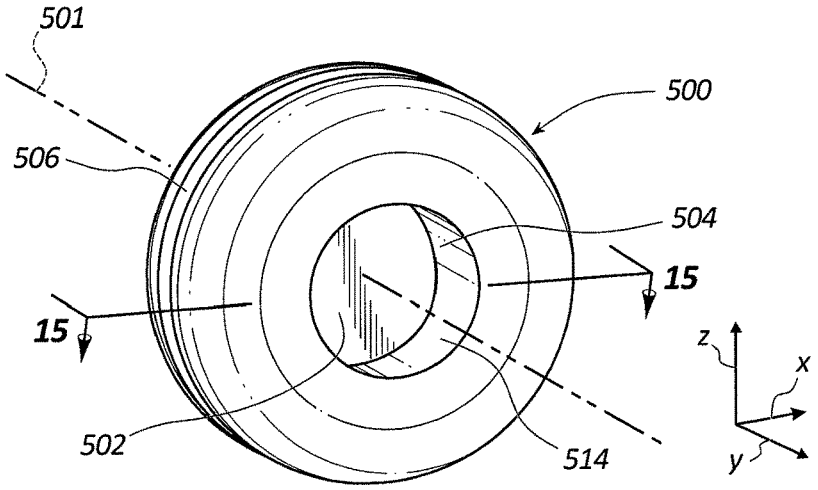
FIG. 14 is an isometric view of another embodiment of a damper.
Figure 15:
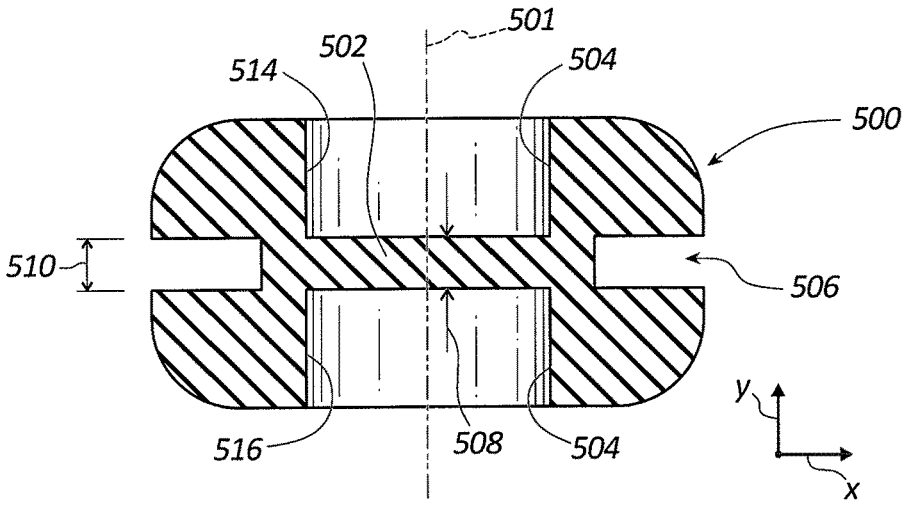
FIG. 15 is a side section view of the damper of FIG. 14.

FIGS. 14-15 show an isometric and side section view of another damper 500 according to the present disclosure. FIG. 15 is a section view taken through lines 15-15 in FIG. 14. This damper 500 is shown without any load applied, but it can be installed between strands of a bowstring (e.g., strands 202, 204) in the same manner as damper 200 in FIG. 2. In this embodiment, a wall 502 is positioned between two opposing recesses 504 in the outer normal surfaces of the damper 500 (i.e., the outer surfaces substantially normal to the central axis 216). The wall 502 can therefore block the area of damper 500 in which the opening 212 passes through damper 200. The wall 502 can provide a seal between the recesses 504 and can therefore prevent passage of accessories or fluids through the damper 500. The damper 500 can also comprise a circumferential channel 506 configured to receive the strands 202, 204 of a bowstring.

The wall 502 of damper 500 can help prevent debris or other material from passing through the space created by the presence of the damper 500 between the strands 202, 204. The wall 502 can also provide radial stability to the damper 500 and help limit stretching or compression of the damper 500 in radial directions.

In one embodiment, the wall 502 can have a normal thickness 508 along the central axis 501 (or in the Y-direction) similar to the width 510 of the channel 506 along the Y-direction. This configuration can provide stability to the channel 506 and thereby prevent buckling of the damper 500 as clamping forces are applied by the bowstring. The thickness 508 can be controlled and designed, however, so that the damper 500 as a whole has a predetermined flexibility and vibration absorptive property. Thus, in some embodiments, the recesses 504 can be compressed so that their sidewalls 514, 516 at least partially collapse radially inward toward a central longitudinal axis 501 when the damper 500 is under pressure. The wall 502 can therefore be configured to fold or buckle to accommodate deformation of the recesses 504.

Figure 16:
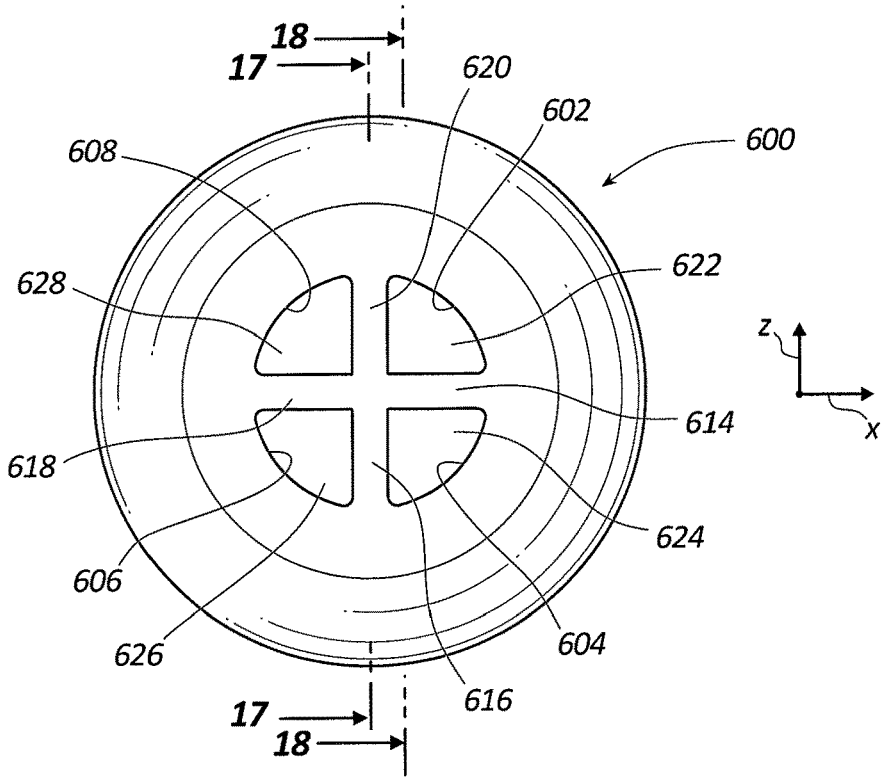
FIG. 16 is an end view of another embodiment of a damper.
Figure 17:
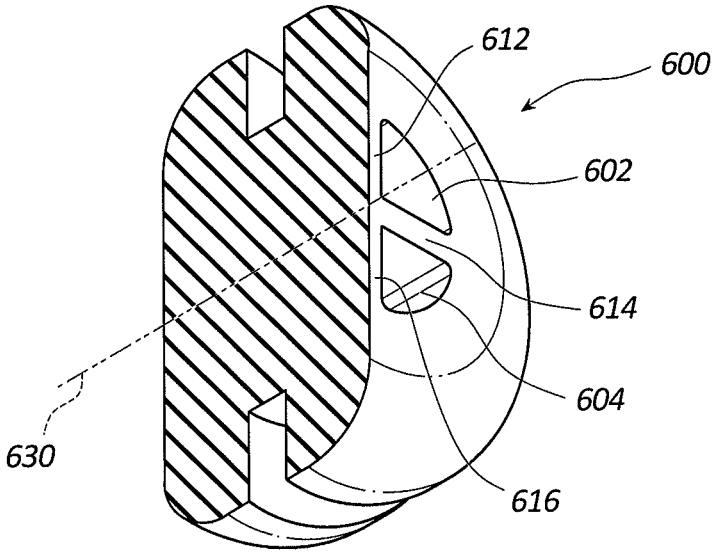
FIG. 17 is a section view of the damper of FIG. 16 taken through section lines 17-17 in FIG. 16.
Figure 18:
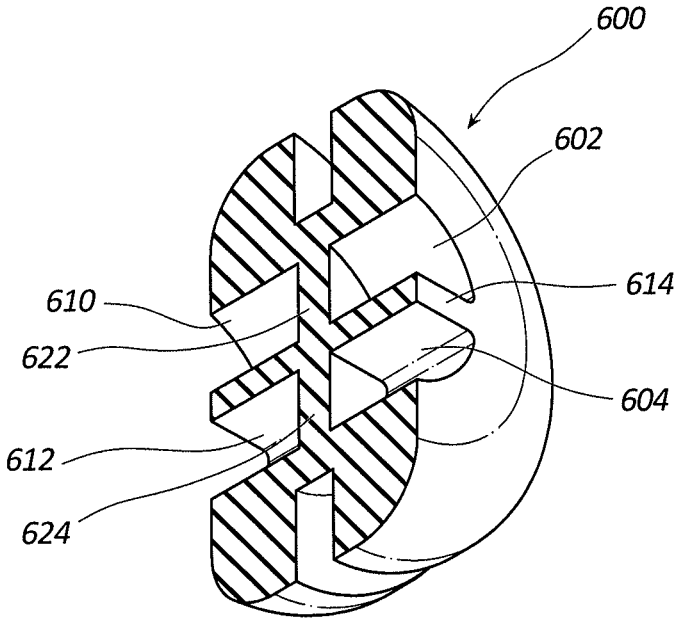
FIG. 18 is a section view of the damper of FIG. 16 taken through section lines 18-18 in FIG. 16.

FIGS. 16-18 illustrate another embodiment of a damper 600 according to the present disclosure. FIG. 16 is an end view, and FIGS. 17 and 18 show section views through respective section lines 17-17 and 18-18 shown in FIG. 16. This damper 600 is comparable to the dampers 200, 500 with a similar circular un-compressed shape, as shown in FIG. 16, but also includes a plurality of longitudinal recesses 602, 604, 606, 608, 610, 612, axially parallel walls 614, 616, 618, 620, and radially parallel walls 622, 624, 626, 628. The longitudinal recesses 602, 604, 606, 608, 610, 612 are similar to the recesses 504 of damper 500, wherein pairs of the longitudinal recesses (e.g., 602 and 610, 604 and 612, as shown in FIG. 18) are positioned on opposite sides of the radially parallel walls 622, 624, 626, 628. Some additional recesses opposite recesses 606 and 608 are not shown.

In this damper 600, the axially parallel walls 614, 616, 618, 620 are configured to provide additional stiffness and rigidity to the damper 600 in a direction perpendicular to the longitudinal axis 630 of the damper 600. In some embodiments, the radially parallel walls 622, 624, 626, 628 can be removed, and the recesses can be instead a set of longitudinal through-holes that extend uninterrupted through the entire thickness of the damper 600.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bowstring damper configured to be positioned between separated strands of an archery bowstring, the damper being laterally compressible and expandable as the bowstring transitions from a rest state to a fully drawn state, the archery bowstring damper comprising:

a body comprising:

a main body portion having an outer surface, a first end, and a second end;

a first flared portion at the first end;

a second flared portion at the second end;

wherein the outer surface, the first flared portion, and the second flared portion form an aperture extending through the main body portion.

2. The archery bowstring damper of claim 1, wherein the aperture comprises a central aperture.

3. The archery bowstring damper of claim 2, wherein the main body portion comprises a longitudinal axis, the central aperture extending partially along the longitudinal axis.

4. The archery bowstring damper of claim 2, wherein the body is a first body and further comprising a second body positioned in the central aperture.

5. The archery bowstring damper of claim 4, wherein the central aperture is a first central aperture and the second body comprises a second central aperture.

6. The archery bowstring damper of claim 1, wherein a wall blocks the aperture.

7. The archery bowstring damper of claim 1, wherein the main body portion comprises a resilient material.

8. The archery bowstring damper of claim 1, wherein the main body portion comprises a circular or annular cross-sectional profile shape, and wherein the first and second flared portions comprise a circular or annular cross-sectional profile shape.

9. An archery bowstring, comprising:

a first strand and a second strand, the first and second strands extending along a longitudinal axis;

a compressible body positioned between the first and second strands and on the longitudinal axis, the compressible body having an opening;

wherein the opening is configured to at least partially collapse as longitudinal tension on the first and second strands increases.

10. The archery bowstring of claim 9, wherein the first and second strands are parts of a single continuous strand.

11. The archery bowstring of claim 9, wherein the first strand has a diameter and the compressible body further comprises a flared end having a radial thickness greater than the diameter of the first strand.

12. The archery bowstring of claim 9, further comprising a rigid accessory positioned in the opening of the compressible body, the rigid accessory being attachable to the compressible body while the compressible body is positioned between the first and second strands.

13. The archery bowstring of claim 9, further comprising a compressible accessory positioned in the opening of the compressible body.

14. The archery bowstring of claim 9, wherein the longitudinal axis is a first longitudinal axis and the opening comprises a second longitudinal axis, the second longitudinal axis being transverse to the first longitudinal axis.

15. The archery bowstring of claim 9, wherein the compressible body comprises a first channel portion and a second channel portion, the first strand being positioned in the first channel portion, the second strand being positioned in the second channel portion.

16. An archery bow, comprising:

a riser;

a first limb and a second limb, the first and second limbs being attached to the riser;

a bowstring including a first strand bundle extending along a longitudinal axis from the first limb to the second limb and a second strand bundle extending along the longitudinal axis from the first limb to the second limb;

a string damper positioned between the first and second strand bundles, the string damper having an opening oriented substantially perpendicular to the longitudinal axis;

wherein the opening has a first length when the bowstring is under a first tension and the opening has a second length when the bowstring is under a second tension.

17. The archery bow of claim 16, wherein the first and second lengths are measured along the longitudinal axis, and wherein the first length is greater than the second length and the first tension is greater than the second tension.

18. The archery bow of claim 16, wherein the first and second lengths are measured orthogonal to the longitudinal axis, and wherein the first length is less than the second length and the first tension is greater than the second tension.

19. The archery bow of claim 16, wherein the opening is a through-hole.

20. The archery bow of claim 16, wherein the opening is a recess in a side of the string damper.

21. A bowstring damper, comprising:

a compressible body having a perimeter;

a channel extending around the perimeter of the compressible body, the compressible body being attachable to a bowstring and being elongated in a longitudinal direction along the bowstring by compression of the compressible body by a portion of the bowstring in the channel;

wherein elongation of the compressible body by the portion of the bowstring in the channel decreases upon a decrease in longitudinal tension in the bowstring.

22. The bowstring damper of claim 21, wherein the compressible body comprises an aperture having a central axis configured to intersect the vertical plane.

23. The bowstring damper of claim 21, wherein the compressible body comprises an aperture, the aperture having a width configured to change in response to a change in longitudinal tension in the bowstring.

* * * * *